United States Patent [19]

Rohr, Jr.

[11] Patent Number: 4,913,075

[45] Date of Patent: Apr. 3, 1990

[54] PUMPLESS BILGE WATER DRAINING SYSTEM AND METHOD

[76] Inventor: James A. Rohr, Jr., 4942 SW. 90 Ter., Cooper City, Fla. 33328

[21] Appl. No.: 173,106

[22] Filed: Mar. 28, 1988

[51] Int. Cl.[4] ..... B63B 13/02

[52] U.S. Cl. ..... 114/185

[58] Field of Search ..... 114/183 R, 185

[56] References Cited

U.S. PATENT DOCUMENTS

| | | | |
|---|---|---|---|
| 931,638 | 8/1909 | Mooke | 114/185 |
| 1,241,408 | 9/1917 | Lizarraga | 114/185 |
| 1,578,621 | 3/1926 | Wood | 114/185 |
| 2,418,252 | 4/1947 | Engle | 114/185 |
| 2,866,431 | 12/1958 | Conover | 114/185 |
| 3,460,503 | 8/1969 | Chalmers | 114/185 |

*Primary Examiner*—Sherman D. Basinger
*Assistant Examiner*—Stephen P. Avila

[57] ABSTRACT

A pumpless bilge water draining system combines a valve system and vented air loop apparatus. The vented air loop is bracketed above the load water line for positive control of the system as well as preventing the system from falling below the water line and endangering the vessel. In motion, a vessel travelling at a sufficient speed will produce a vacuum in the system thus draining accumulated water in the bilge area through the system's pick-up; and at rest, a ball valve is utilized, in an engaged position, to close the valve when it is desired to do so.

10 Claims, 1 Drawing Sheet

PUMPLESS BILGE WATER DRAINING SYSTEM AND METHOD

FIELD OF THE INVENTION

This invention relates to a system for discharging bilge water from vessels. More specifically, this invention relates to a pumpless system for discharging bilge water from a vessel.

BACKGROUND OF INVENTION

Bilge water is water which enters a ship by any means and lies upon her inner bottom or bilge. It is desirable to remove the bilge water from the vessel and several systems have been devised which attampt to accomplish this goal. However, most currently used methods of bilge discharge are deficient in their effectiveness. Two types of bilge draining systems include pump and pumpless bilge draining systems. While pumpless bilge drainers are known, they restrict themselves in such a way as to be the casual effect for jeopardizing the safety of the vessel.

Specifically, U.S. Pat. No. 831,633 issued to Charles W. Moore teaches a pumpless bilge drainer gate system. However, Moore's device is difficult to utilize in that it does not provide for above load water line control of the drainer. The Moore drainer relies on a check valve 22, to control water reentry into bilge. Should the check valve be offset for any reason, the craft is in jeopardy of taking in water thus resulting in possible submersion of the vessel. A second type of pumpless bilge drainer is embodied in G. A. Woods' issued U.S. Pat. No. 1,578,621 which discloses a valveless air vent using a pressure induced suction as a means for bilge water removal. However, such a teaching does not take into account the possibility of a failure of clogging of the vent. Should the vent become clogged with debris, a reverse syphonic effect will occur and cause water to enter the vessel, jeopardizing the craft, contrary to the intent of Woods. In addition, Wood does not teach the use of a valve to control water action or to provide a means of regulation.

Electric bilge pumps are well known throughout the industry, however, such pumps have a high system failure rate primarily due to poor electrical bilge wiring, stuck float switches, debris in the pump intake and water intrusion into the submerged pump or float switch. Additionally, maintenance is a significant problem with an electric bilge pump system. Moreover, in a pump of the centrifical type, once the water level is below the intake at the bottom of the pump and/or the float switch cuts off, remaining bilge water in the above waterline discharge hose flows back into the vessel.

SUMMARY OF THE INVENTION

It is the primary objective of the present invention to provide a pumpless bilge water draining system which combines a valve system and vented air loop apparatus. The vented air loop is bracketed above the load water line for positive control of the system as well as preventing the system from falling below the load water line and endangering the vessel. In motion, a vessel travelling at a sufficient speed will produce a vacuum in the system thus draining accumulated water in the bilge area through the system's pick-up; and at rest, a ball valve is utilized, in an engaged position, to close the valve when it is desired to do so.

It is another object of this invention to provide above load water line system control as well as system regulation and positive water control for extended in-water storage.

It is yet another object of the present invention to provide a low maintenance bilge draining system due to its lack of moving parts and non-electrical requirements.

It is still another object of the invention to provide a pumpless bilge draining system which removes all of the bilge water present at the pick-up as the vacuum of the system is produced at the discharge point and not at the pick-up point.

It is still another object of the invention to provide a method for the draining system invention to regulate bait wells, for draining water holds or tanks, and for other uses where pumpless removal of liquids is desired.

It is still another object of the invention to be able to move any fluid and provide a regulated mix from the draining fluid to the moving liquid discharge point.

It is still another object of the invention to provide an air source to the moving fluid at the discharge point.

DRAWINGS

The above and other objects of the invention will be more fully apparent and understood from a consideration of the following detailed drawings, wherein.

DESCRIPTION OF A PREFERRED EMBODIMENT

Figure 1:
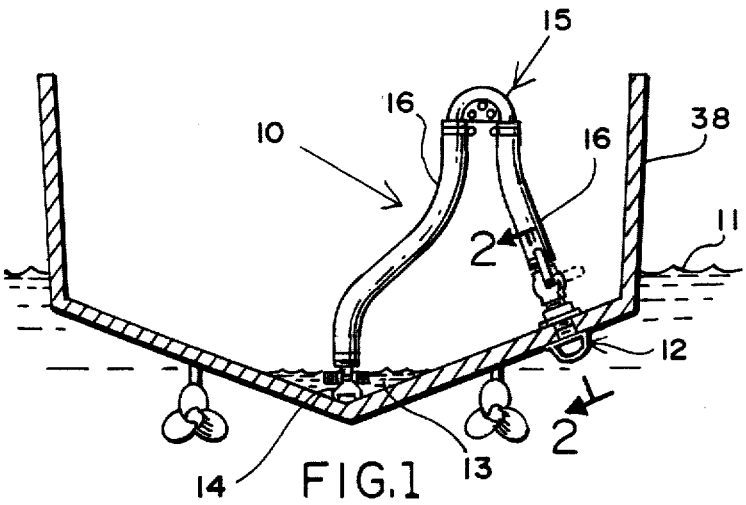
FIG. 1 is a cross-section end view of a vessel utilizing the pumpless draining system.

FIG. 1 illustrates the bilge draining system 10 in relation to a cross-section end view of a vessel 38 partially submerged in water. As can be seen in FIG. 1, the thru-hull 12 and pick-up 14 are located below the load waterline 11. The vessel 38 can have any shape below the waterline so long as its shape allows for the installation of the thru-hull 12 by any means in a submerged state during operation of the vessel 38. The vented loop 15 is located above the load waterline 11. Hoses 16 are attached from the thru-hull 12 to the vented air loop 15 and again from the vented air loop 15 to the pick-up 14 which is partially submerged in bilge water 13. It is preferred that a non-permeable neoprene hose 16 be used which has a wire wound core to eliminate possible collapse which may occur when the vessel obtains sufficient speed to produce the system's vacuum.

Figure 2:
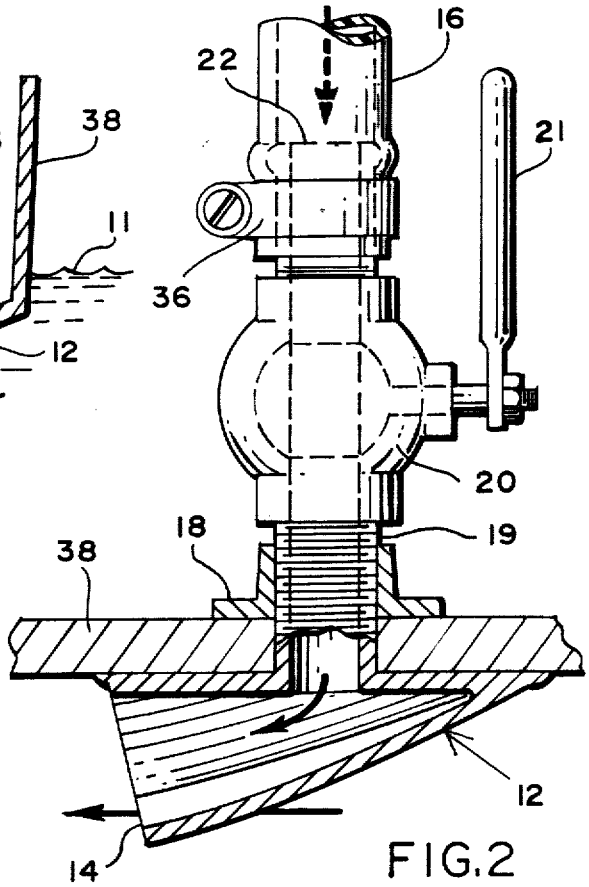
FIG. 2 is a partial longitudinal cross-section view of the thru-hull and ball valve taken at line 2 of FIG. 1.

FIG. 2 shows a longitudinal cross-section view of the thru-hull 12 and ball valve 20. The thru-hull 12 is mounted through the boat bottom per specifications of the vessel 38. The efficiency of the system is maximized when the thru-hull 12 is positioned as far forward toward the fore of the hull of the vessel 38 while still maintaining a submerged relationship during dynamic operation of the vessel 38. The thru-hull 12 is positioned such that the area of the thru-hull 12 increases fore to aft in relation to the underwater portion of the vessel 38. It is also possible that the shape of the thru-hull 12 can change to increase vacuum potential. The thru-hull 12 has a threaded shank 19 which is perpendicular to the base of the thru-hull 12. A flange nut 18, positioned interiorly to that of the vessel 38, is secured about the threaded shank 19 such that the thru-hull 12 is secured to the vessel 38. A ball valve 20 with female pipe threads at both ends thereof is secured to the threaded shank 19 of the thru-hull 12. The ball valve 20 comprises a ball lever 21 which provides system control It is preferred that the ball lever 21 have an arc of 90 degrees and while a manual ball valve 20 is disclosed, the ball valve 20 can be regulated electrically by a float switch or float valve. Attached at the upper portion of the ball valve 20 is a tail piece 22. Said tail piece 22 is an adaptor component attached to the ball valve 20 by a threaded means. A first hose 16 is attached at one end to the upper end of the tail piece 22 and secured by a clamp 36.

Figure 3:
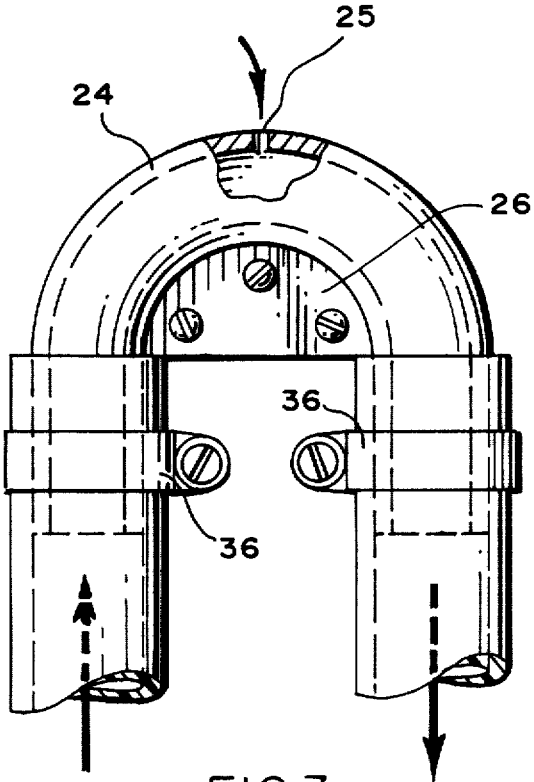
FIG. 3 depicts a front plan view of a vented air loop and hose attachments.
Figure 4:
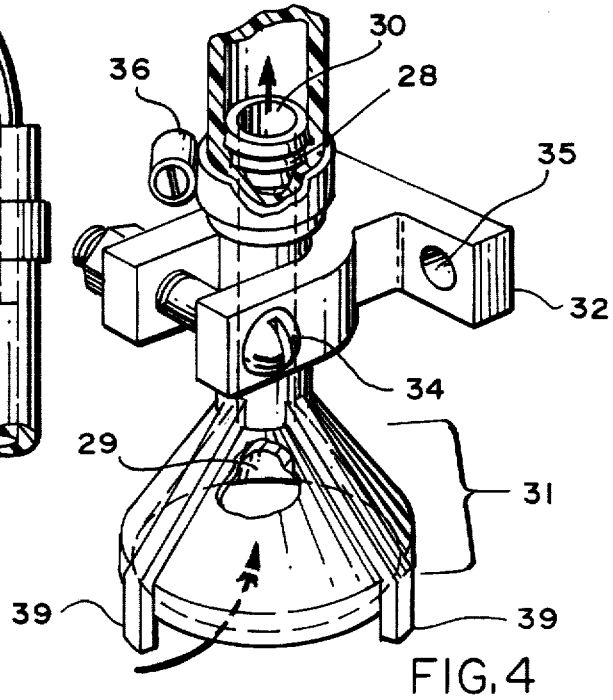
FIG. 4 is a perspective view of the pick-up and bracket assembly.

Continuing with FIG. 3, the first hose 16 is secured at its free end to the vented air loop 15 by an interference fit secured by a clamp 36. The vented air loop 15 has a vent hole 25 located at the zenith of the vented air loop 15. The vented air loop 15 has a U-shape configuration 24 and is positioned invertedly within the system and above the load water line 11. A mounting plate 26 is positioned interior to the concave portion of the vented air loop 15 which allows for the required vertical surface mounting of the vented air loop 15. A second hose 16 is attached to the free end of the vented air loop 15 at one end and attached above the pick-up 14 at its barbed shank 28 and secured at both ends by clamps 36. The shank of the pick-up 14, FIG. 4, is so barbed at its top and is perpendicular to the base of the pick-up 14. The pick-up 14 has an inlet 29 and an outlet 30. The diameter of the inlet 29 is larger than the diameter of outlet 30. Additionally, the inlet 29 has a conical shape 31 such that the diameter of the base of the inlet 29 is larger than the diameter of the top of the inlet 29. In addition, pick-up 14 has standoffs 39 at its base to control minimum clearance to the working vessel's inner bottom. Below the barbed shank 28 of the pick-up 14, a bracket 32 is placed thereon which clamps around the portion of the pick-up shank which is not barbed. The bracket 32 is then clamped to the unbarbed shank portion of the pick-up 14 and held in place by a nut and bolt assembly 34. This bracket 32 allows for easy accessibility and cleaning of the pick-up 14. The bracket 32 has mounting holes 35 perpendicular to the clamping portion of the bracket 32 for securing to the surface of the vessel 38.

In operation, the liquid moving horizontally to the boat's bottom in a planing craft is disturbed and cause to change direction over the surface of the thru-hull 12. This decreases the velocity relative to the undisturbed moving water and increases the pressrue surrounding the exterior portion of the thru-hull 12. The pressure differential between the disturbed water and the atmospheric pressure within the system results in a vacuum created within the thru-hull 12. The vacuum is controlled by the ball valve 20, and the resultant vacuum created during operation. In its open state, the ball valve has no practical effect on the system's performance. The vacuum created within the thru-hull 12 is felt through the system to the pick-up 14.

The vented air loop 15 is installed above the load water line sufficiently to eliminate the direct discharge of water into the boat under normal working conditions. The vent hole 25 is small in area in relation to that of the thru-hull 12. The vent hole 25 reduces the possibility of a syphonic effect within the system. However, the vent hole 25 is not too large as to negatively affect the total vacuum such that the system 10 would not function.

The pick-up 14 is mounted at the lowest portion of the boat's bottom or working vessel and in operation, fluid will be moved from the pick-up 14 through the system and educted at the thru-hull 12 outlet. In order to maximize performance, the orientation of the thru-hull 12 on the bottom of the boat must be as close to parallel with the moving water and submerged during dynamic operation. In the event of extended storage of the boat in water or a leak in the system, the ball valve should be closed.

In addition, while a pumpless bilge water draining system is described as a preferred embodiment, the present invention may be used in a similar manner to regulate bait wells, drain water holding tanks or be used for the removal of other pooled liquids when such is desired which can be accomplished during normal operation of the boat. Further, this sytem may be used in any moving fluid stream where a vacuum or movement of fluid froma different source can be utilized. Further still this system can be used where a regulated air source is required in a moving fluid stream.

What is claimed is:

1. A pumpless bilge draining apparatus, comprising, in combination:

a thru-hull;

a valve;

a means for attaching said thru-hull to said valve;

a tail piece;

a vented air loop having a vent hole;

a pick-up;

a means for attaching said vented air loop to said pick-up and said valve, said attaching means comprising a first hose, said first hose being attached at one end to the top of said pick-up and attached at the other end to the vented air loop; and a second hose, said second hose being attached at one end to the free end of said vented air loop and at the other end to said tail piece, said tail piece being threadedly attached to the upper end of said valve, and a means for attaching said apparatus to a vessel, said means comprising a mounting plate securing said vented air loop in a position above the load waterline, a bracket securing said pick-up such that said bracket is perpendicular to said pick-up and is clamped to an unbarbed portion of said pick-up shank and mounted to a vessel and secured by a nut and bolt assembly, and a flange nut securing said thru-hull to said vessel bottom.

2. In the apparatus of claim 1, wherein the area of said thru-hull increases from fore to aft in relation to said thru-hull's position to the underwater portion of a vessel.

3. In the apparatus of claim 1, said means for attaching said thru-hull to said valve further comprising a threaded shank perpendicularly attached to the base of said thru-hull and capable of being threadedly secured to said valve.

4. In the apparatus of claim 1, said valve having a lever with 90 degree arc range.

5. In the apparatus of claim 1, said first and seconds hoses being further secured at their ends by clamps.

6. In the apparatus of claim 1, said first and second hoses being manufactured from a neoprene material with a wire wound interiorly therein.

7. In the apparatus of claim 1, said vented air loop having an inverted U-shape configuration with said vent hole being located at the zenith of the U-shape bend.

8. In the apparatus of claim 1, wherein the pick-up is conically shaped such that the base of said pick-up is larger in diameter than that of its top, said pick-up further having a top end barbed shank outlet perpendicularly positioned to that of the base of said pick-up and said pick-up having standoffs at its base.

9. In the apparatus of claim 1, said thru-hull, valve, vented air loop and pick-up being manufactured from bronze or any non-corrosive material.

10. In the apparatus of claim 1, said valve being of a ball type.

* * * * *